US008889975B2

(12) United States Patent
Komatsu et al.

(10) Patent No.: US 8,889,975 B2
(45) Date of Patent: Nov. 18, 2014

(54) KEYBOARD APPARATUS

(71) Applicant: Yamaha Corporation, Hamamatsu (JP)

(72) Inventors: Akihiko Komatsu, Hamamatsu (JP); Shigeru Muramatsu, Mori-machi (JP); Hisashi Takeyama, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 79 days.

(21) Appl. No.: 13/794,680

(22) Filed: Mar. 11, 2013

(65) Prior Publication Data

US 2013/0233150 A1 Sep. 12, 2013

(30) Foreign Application Priority Data

Mar. 12, 2012 (JP) ..... 2012-054517

(51) Int. Cl.
*G10C 3/12* (2006.01)

(52) U.S. Cl.
CPC ..... *G10C 3/12* (2013.01)
USPC ..... 84/439

(58) Field of Classification Search
USPC ..... 84/423 R, 439, 432–438, 441, 442, 84/446–448
See application file for complete search history.

(56) References Cited

U.S. PATENT DOCUMENTS 4,901,614 A 2/1990 Kumano et al.
8,093,480 B2 * 1/2012 Yoshida ..... 84/439

FOREIGN PATENT DOCUMENTS

JP 01-169494 A 7/1989
JP 04-166994 A 6/1992
JP 04-1166994 A 6/1992

* cited by examiner

*Primary Examiner* — Kimberly Lockett
(74) *Attorney, Agent, or Firm* — Morrison & Foerster LLP

(57) ABSTRACT

A keyboard apparatus, including: a key that is pivotable by depressing and release operations between: a pivotal movement start position corresponding to a non-key depression state; and a pivotal movement end position corresponding to a key-depression end state; a hammer body that is pivotable between: a pivotal movement start position; and a pivotal movement end position for imparting inertia to the key depressing operation; and an elastic portion to apply elastic force to at least one of the key and the hammer body, wherein the elastic portion is configured not to apply the elastic force to the key and the hammer body in the non-key depression state and configured to start to apply the elastic force in a direction toward the pivotal movement start position to the at least one of the key and the hammer body from a certain point in a forward stroke of the key depressing operation.

8 Claims, 3 Drawing Sheets

KEYBOARD APPARATUS

CROSS REFERENCE TO RELATED APPLICATION

The present application claims priority from Japanese Patent Application No. 2012-054517 filed on March 12, the disclosure of which is herein incorporated by reference in its entirety.

BACKGROUND OF THE INVENTION

1. Field of the Invention

The present invention relates to a keyboard apparatus having hammer bodies each configured to impart inertia to a key depressing motion.

2. Description of Related Art

There has been conventionally known a keyboard apparatus having hammer bodies each configured to impart inertia to a depressing motion of an associated key for providing a key depression touch or feeling which approximates to that of an acoustic piano. In a keyboard apparatus disclosed in the following Patent Literature 1, for instance, the hammer body is driven by the associated key so as to pivot, when the key is depressed.

In such a keyboard apparatus, in general, the hammer body undergoes a force by its own weight in a direction toward a start position of the pivotal movement of the hammer body that corresponds to a key release direction. Accordingly, when the key is released after termination or end of the key depression, the hammer body and the key pivot in the direction toward the start position of the pivotal movement mainly by the own weight of the hammer body, so that the hammer body and the key return to respective original positions.

Patent Literature 1: JP-A-1-169494

SUMMARY OF THE INVENTION

Since the force by which the hammer body and the key return after termination of the key depression is exerted mainly by the own weight of the hammer body, prompt or quick return cannot be expected, resulting in disadvantages in terms of repeated or successive key depression.

In acoustic pianos, a damper is in contact with an associated string in a non-key depression state in which the key is not depressed, except for keys in the treble range (high-pitch keys). The damper is configured to be driven by the associated key so as to separate away from the string in the middle of a forward stroke of the key depression. From the time point when the damper separates away from the string, a load of the key depression increases by an amount corresponding to the weight of the damper. This phenomenon is explained in terms of a reverse stroke of the key depression (in terms of key release). That is, at an initial period of the reverse stroke of the key-depression (key releasing operation), namely, in a period before the damper comes into contact with the string (i.e., when the key is located at a deep stroke position), the key undergoes a return force (by which key returns) that is increased by an amount corresponding to the weight of the damper, as compared with a period after the damper contacts the string. The patent Literature 1 does not consider reproduction of the key depression touch in relation to the increase of the load corresponding to the weight of the damper in acoustic pianos.

The present invention has been developed to solve the conventionally experienced problem. It is therefore an object of the invention to provide a keyboard apparatus in which keys and hammer bodies can return promptly or quickly after termination of key depression. The object indicated above may be attained according to a principle of the present invention, which provides a keyboard apparatus, comprising:

a key (10) configured to be pivotable about a key fulcrum (Pk), by a depressing operation and a release operation, between: a pivotal movement start position corresponding to a non-key depression state; and a pivotal movement end position corresponding to a key-depression end state;

a hammer body (HM) configured to be pivotable about a hammer body fulcrum (Ph), by the depressing operation and the release operation of the key, between: a pivotal movement start position corresponding to the non-key depression state; and a pivotal movement end position corresponding to the key-depression end state and configured to impart inertia to the depressing operation of the key; and an elastic portion (22, 23; 32, 33; 43) configured to be capable of applying an elastic force to at least one of the key and the hammer body, wherein the elastic portion is configured not to apply the elastic force to the key and the hammer body in the non-key depression state and configured to start to apply the elastic force in a direction toward the pivotal movement start position to the at least one of the key and the hammer body from a certain point in a forward stroke of the depressing operation of the key.

The reference numerals in the brackets attached to respective constituent elements in the above description correspond to reference numerals used in the following embodiments to identify the respective constituent elements. The reference numerals attached to each constituent element indicates a correspondence between each element and its one example, and each element is not limited to the one example.

BRIEF DESCRIPTION OF DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

There will be hereinafter explained embodiments of the present invention with reference to the drawings.

<First Embodiment>

Figure 1A:
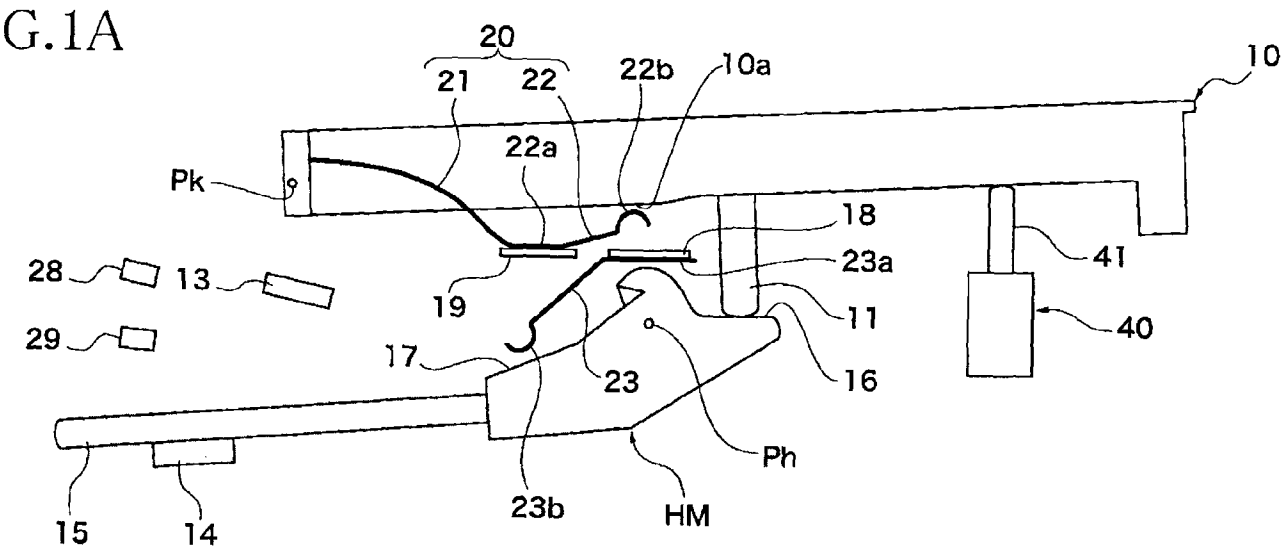
FIGS. 1A and 1B are schematic side views each showing a principal part of a keyboard apparatus according to a first embodiment of the present invention when focusing on one key.
Figure 1B:
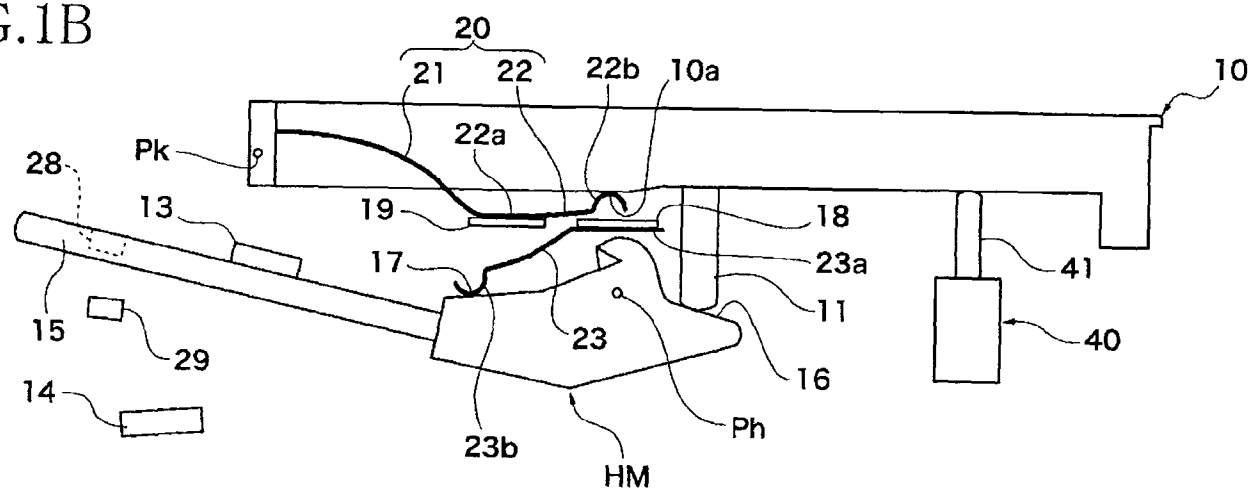

FIGS. 1A and 1B are schematic side views each showing a principal part of a keyboard apparatus according to a first embodiment of the present invention when focusing on one key. FIG. 1A shows a state in which a key is not depressed (i.e., non-key depression state) and FIG. 1B shows a state in which key depression is terminated or ended (i.e., key-depression terminated state).

The present keyboard apparatus has a plurality of keys 10 juxtaposed with one another and hammer bodies HM that correspond to the respective keys 10. The present keyboard apparatus is suitable for use in a keyboard musical instrument, an electronic keyboard musical instrument, and the like. In FIGS. 1A and 1B, a white key is illustrated as the key 10. In the present invention, the plurality of keys 10 are constituted by white keys and black keys that are basically identical in construction, and constituent elements corresponding to the white keys and constituent elements corresponding to the black keys are basically identical in construction. In the following explanation, the right side and the left side in FIGS. 1A and 1B are referred to as a front side and a rear side, respectively.

Each key 10 is disposed on a frame (not shown) so as to be pivotable, in a key depression direction and a key release direction, about a key fulcrum Pk located at a rear end portion of the key 10, by a depressing operation and a releasing operation of the key 10. The key 10 has a drive portion 11 that protrudes therefrom. Each hammer body HM is disposed below an associated key 10. The hammer body HM is configured to be pivotable about a hammer fulcrum Ph, so as to impart inertia to a key depressing motion of the associated key 10 via the drive portion 11.

The hammer body HM has a rod-like portion 15 which is formed of a metal such as iron and in which the mass of the hammer body HM is concentrated. The hammer body HM always undergoes a force in a counterclockwise direction in FIG. 1 by its own weight. In a main body (constituted by a chassis, a key bed, the frame, etc.) of the keyboard apparatus, a hammer upper-limit stopper 13 and a hammer lower-limit stopper 14 are provided.

An actuator 40 is disposed below the front portion of each key 10. The actuator 40 is configured such that its plunger 41 exhibits a thrust force based on a control of a CPU (not shown), thereby applying a force to the key 10 so as to give a force sense. Force sense control data for giving the force sense is pre-stored in a storage section (not shown) as a force-sense giving table. However, it is not essential to control so as to give the force sense.

A fixation portion 18 and a fixation portion 19 are fixed to the main body of the keyboard apparatus. A key leaf spring 20 as an elastic member engages with the key 10. The key leaf spring 20 is constituted integrally by a rear half portion 21 functioning as a key return spring and a front half portion 22 as a second elastic portion. The key leaf spring 20 is fixed, by screws or the like (not shown), to the fixation portion 19 at a fixed portion 22*a* that is a longitudinally middle portion of the key leaf spring 20. In the non-key depression state, the rear half portion 21 of the key leaf spring 20 engages with the key 10 such that the rear half portion 21 somewhat sags between a position above the key fulcrum Pk located at the rear end portion of the key 10 and the fixation portion 19, so as to push the key 10 in the key release direction.

On the other hand, a distal end portion 22*b* that is a free end of the front half portion 22 does not contact a lower surface 10*a* of the key 10 in the non-key depression state, as shown in FIG. 1A. The lower surface 10*a* starts to come into abutting contact and engagement with the distal end portion 22*b* from a certain point in a forward stroke of the key depression (i.e., key-depression forward stroke), in other words, in the middle of the key-depression forward stroke. It is noted here that the certain point indicated above does not include a start position of the pivotal movement of the key 10 (i.e., pivotal movement start position). Here, "the lower surface 10*a* starts to come into abutting contact and engagement with the distal end portion 22*b* from a certain point in a forward stroke of the key depression" means that the lower surface 10*a* of the key 10 does not contact the distal end portion 22*b* where a stroke amount of the key 10 from the pivotal movement start position is less than a prescribed amount and the lower surface 10*a* of the key 10 contacts the distal end portion 22*b* where the stroke amount of the key 10 from the pivotal movement start position is equal to or larger than the prescribed amount. Thus, the position of the distal end portion 22*b* is set as a position at which the key 10 comes into abutting contact with the distal end portion 22*b* when the key is located at a position between: the pivotal movement start position at which the key 10 starts to move in the key depressing operation; and an end position of the pivotal movement of the key 10 (i.e., pivotal movement end position) at which the key 10 is pivoted to the largest extent from the pivotal movement start position. This position between the pivotal movement start position and the pivotal movement end position is hereinafter referred to as a "key intermediate position". The key intermediate position is a position different from the pivotal movement start position and the pivotal movement end position.

There is provided, above the hammer body HM, a hammer leaf spring 23, as a first elastic position, that is a separate member from the key leaf spring 20. The hammer leaf spring 23 is fixed at one end portion 23*a* thereof to the fixation portion 18. The other end portion 23*b* that is a free end of the hammer leaf spring 23 extends obliquely downward toward the rear side. The other end portion 23*b* of the hammer leaf spring 23 does not contact a spring-contact surface 17 of the hammer body HM in the non-key depression state, as shown in FIG. 1A. The spring-contact surface 17 starts to come into contact and engagement with the other end portion 23*b* from the certain point in the key-depression forward stroke. Thus, the position of the other end portion 23*b* is set as a position at which the hammer body HM comes into contact with the other end portion 23*b* when the key 10 is located at the key intermediate position.

As shown in FIG. 1A, in the non-key depression state, a start position of the pivotal movement of the hammer body HM (i.e., pivotal movement start position) is defined such that the rod-like portion 15 of the hammer body HM is held in abutting contact with the hammer lower-limit stopper 14 by the own weight. At the same time, a driven portion 16 of the hammer body HM is held in abutting contact with the drive portion 11*c* of the key 10, so that the pivotal movement start position (i.e., rest position) of the key 10 is defined. In this respect, there may be provided a stopper configured to engage with the key 10 for inhibiting the key 10 from further pivoting in the key release direction.

When the key 10 is depressed, namely, when the key depressing operation is conducted, the drive portion 11 of the key 10 drives the driven portion 16 of the hammer body HM. As a result, the hammer body HM pivots in a direction (i.e., a clockwise direction in FIGS. 1A and 1B) corresponding to a key depression direction in which the key 10 is depressed, and the rod-like portion 15 of the hammer body HM comes into abutting contact with the hammer upper-limit stopper 13. Thus, the pivotal movement end position (end position) of each of the hammer body HM and the key 10 is defined, as shown in FIG. 1B.

When the lower surface 10*a* of the key 10 comes into abutting contact and engagement with the distal end portion 22*b* of the front half portion 22 of the key leaf spring 20 in the key-depression forward stroke, the front half portion 22 elastically bends, whereby the front half portion 22 applies an elastic force to the key 10 so as to give the key 10 a force to push the key 10 toward the pivotal movement start position. Concurrently, the spring-contact surface 17 of the hammer body HM comes into abutting contact and engagement with the other end portion 23*b* of the hammer leaf spring 23 and accordingly the hammer leaf spring 23 elastically bends, whereby the hammer leaf spring 23 applies an elastic force to the hammer body HM so as to give the hammer body HM a force to push the hammer body HM toward the pivotal movement start position.

Where the key 10 and the hammer body HM pivot by moving in conjunction with each other while the drive portion 11 of the key 10 and the driven portion 16 of the hammer body HM are held in engagement with each other without separating away from each other, the position of the key or the timing at which the lower surface 10*a* comes into abutting contact with the distal end portion 22*b* substantially coincides with the position of the key 10 or the timing at which the spring-contact surface 17 comes into contact with the other end portion 23*b*. Further, the position of the key 10 or the timing described above is set so as to substantially correspond to a position of the key 10 or timing at which a damper separates away from an associated string in a forward stroke of key depression in acoustic pianos.

Hereinafter, the "position or timing" in the key-depression forward stroke as to the abutting contact relation between the key 10 and the front half portion 22 may be simply referred to as "timing" where appropriate. Similarly, the "position or timing" in the key-depression forward stroke as to the abutting contact relation between the hammer body HM and the hammer leaf spring 23 may be simply referred to as "timing" where appropriate.

Where the keyboard apparatus is applied to an electronic keyboard musical instrument, it is preferable to provide a hammer-striking detect sensor 28 and a damper-separation detect sensor 29, as shown in FIGS. 1A and 1B. Each of the sensors 28, 29 is constituted by an optical sensor or the like fixed to the main body of the keyboard apparatus and is configured to output a signal when the rod-like portion 15 reaches the position at which the sensor is disposed. The position of the hammer-striking detect sensor 28 is set such that the hammer-striking detect sensor 28 outputs a signal at a time point when the rod-like portion 15 comes into abutting contact with the hammer upper-limit stopper 13 in the key-depression forward stroke or immediately before the time point. The position of the damper-separation detect sensor 29 is set such that the rod-like portion 15 moves across the damper-separation detect sensor 29 at substantially the same timing as timing when the spring-contact surface 17 comes into abutting contact with the other end portion 23*b* of the hammer leaf spring 23.

Figure 2:
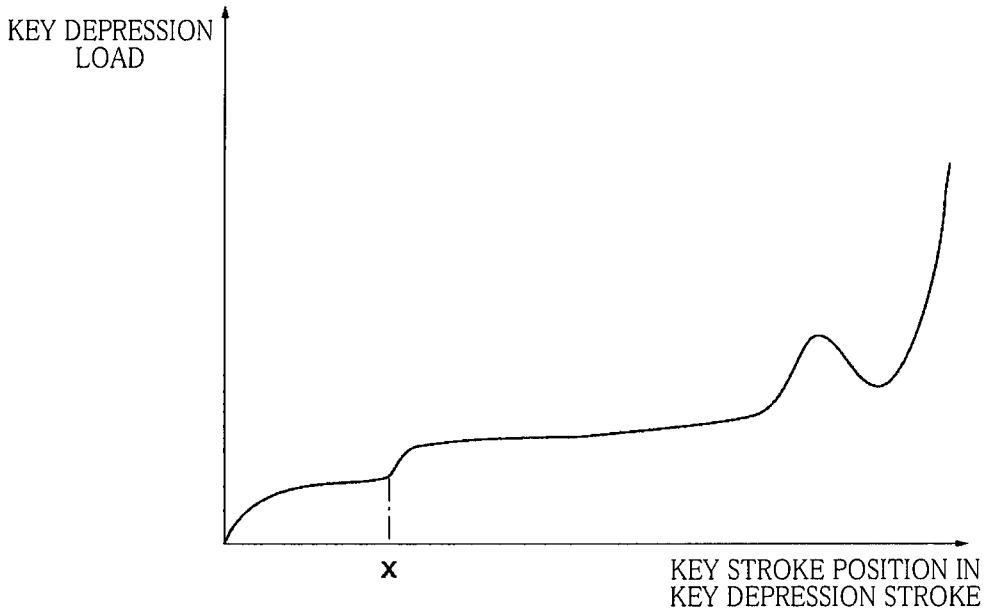
FIG. 2 is a graph showing a relationship between key stroke position in key-depression stroke and key depression load.

FIG. 2 shows a relationship between key stroke position in the key-depression stroke and key depression load. Where the key 10 and the hammer body HM pivot by moving in conjunction with each other in the key-depression forward stroke, a stroke position x in FIG. 2 corresponds to abutting contact timing at which the lower surface 10*a* of the key 10 comes into abutting contact with the distal end portion 22*b* of the key leaf spring 20 and the spring-contact surface 17 of the hammer body HM comes into abutting contact with the other end portion 23*b* of the hammer leaf spring 23. The stroke position x is about 3.5 mm deep from the position of the upper surface of the key 10 (i.e., key-depression surface) in the non-key depression state. In this respect, when the key 10 is located at the stroke position x, the stroke amount of the key 10 is equal to the above-indicated prescribed amount. From the abutting contact timing onward, the force to push the key 10 by the elasticity of the front half portion 22 of the key leaf spring 20 and the force to push the hammer body HM by the elasticity of the hammer leaf spring 23 are respectively applied to the key 10 and the hammer body HM, resulting in an increase in the load in the key depression (i.e., key depression load). Accordingly, it is possible to artificially realize the feeling of load increase by an amount corresponding to the weight of the damper that is felt in the middle of the key depression in acoustic pianos. Hereinafter, this feeling is simply referred to as the "load increase feeling corresponding to the damper weight" where appropriate.

The keys 10 in which such a load increase feeling corresponding to the damper weight is realized are preferably the keys 10 except the keys in the treble range (high-pitch keys), as in acoustic pianos.

In FIG. 2, the reaction force is temporarily sharply increased in the vicinity of the key depression by the actuator 40 so as to generate an artificial click feeling for permitting the key depression touch to approximate to that of acoustic pianos.

In the meantime, the load increase owing to the elasticity of the front half portion 22 and the hammer leaf spring 23 is maintained even in the key-depression terminated state. Accordingly, when the key 10 is released, namely, when a key releasing operation is conducted after termination of the key depression, the return force owing to the elasticity of the front half portion 22 and the hammer leaf spring 23 is added to the return force owing to the own weight of the hammer body HM, resulting in quick or prompt return of the key 10 and the hammer body HM.

The present embodiment enables the key 10 and the hammer body HM to promptly or quickly return after termination of the key depression.

The timing at which the front half portion 22 and the hammer leaf spring 23 respectively apply the elastic forces to the key 10 and the hammer body HM in the middle of the key-depression forward stroke corresponds to the timing at which the damper separates away from the associated string in the key-depression forward stroke in acoustic pianos. Accordingly, it is possible to artificially realize the load increase feeling corresponding to the damper weight that is felt in the middle of the key depression in acoustic pianos. In particular, since the timing at which the front half portion 22 applies the elastic force to the key 10 and the timing when the hammer leaf spring 23 applies the elastic force to the hammer body HM substantially coincide with each other, the load increase feeling corresponding to the damper weight can be made clear.

In the meantime, the hammer-striking detect sensor 28 outputs a signal upon termination of the key depression or immediately before termination of the key depression. The output signal of the hammer-striking detect sensor 28 triggers a tone generation control section (not shown) to generate tones. Further, the tone generation control section switches the tone colors in accordance with the output signal of the damper-separation detect sensor 29. According to the arrangement, it is possible to switch the tone colors depending upon whether or not the spring-contact surface 17 is in abutting contact with the other end portion 23*b* of the hammer leaf spring 23. This corresponds to an arrangement in which the tone colors are switched depending upon whether or not the damper is in contact with the string. Since the timing of generation of the reaction force by the hammer leaf spring 23 coincides with the timing of switching the tone colors coincide with each other, it is possible to link the switching of the tone colors to the switching of the touch feeling, resulting in increased reality.

In the present embodiment, the front half portion 22 and the hammer leaf spring 23 individually push the key 10 and the hammer body HM, respectively, thereby enabling the key 10 and the hammer body HM to return quickly with high efficiency. It is noted, however, that the advantages are ensured to a certain extent even in an arrangement in which only the hammer leaf spring 23 is provided, since the key 10 returns by returning of the hammer body HM.

In the present embodiment, in order to reproduce the load increase feeling corresponding to the damper weight in acoustic pianos, the timing at which the front half portion 22 and the hammer leaf spring 23 respectively apply the elastic forces to the key 10 and the hammer body HM is set so as to correspond to the stroke position x (about 3.5 mm) of the key 10. When focusing only on the advantage of quick return of the key 10 and the hammer body HM after termination of the key depression, the timing may be anywhere in the middle of the key-depression forward stroke or may be at a stroke position just before termination of the key depression, namely, at a stroke position near the end of the key-depression forward stroke.

Since the rear half portion 21 and the front half portion 22 of the key leaf spring 20 are formed integrally with each other, the number of components is reduced. However, since the rear half portion 21 and the front half portion 22 have mutually different functions, the rear half portion 21 and the front half portion 22 may be formed as separate members.

<Second Embodiment>

In the illustrated first embodiment, the front half portion 22 and the hammer leaf spring 23 are fixed to the main body of the keyboard apparatus. In a second embodiment of the present invention, springs corresponding to those are fixed to the key 10 and the hammer body HM, respectively.

Figure 3A:
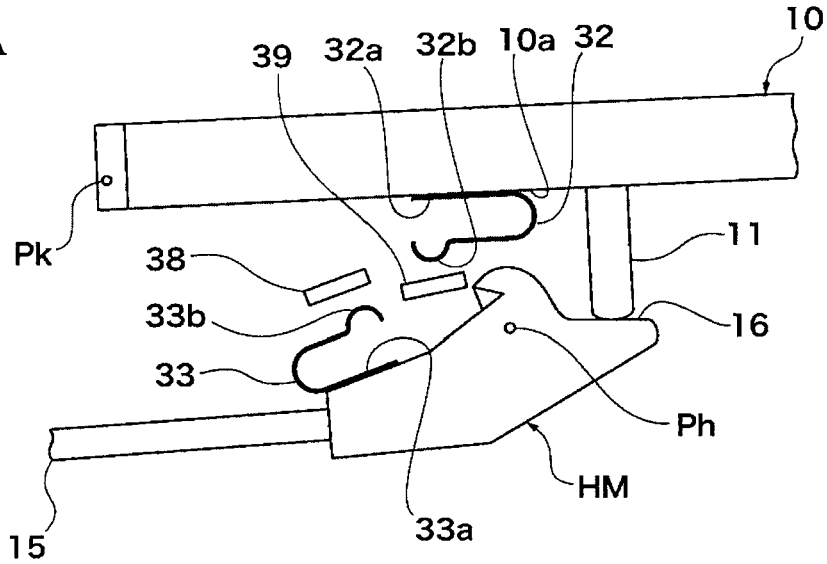
FIGS. 3A-3C are schematic views respectively showing keyboard apparatus according to a second embodiment, a third embodiment, and a fourth embodiment of the present invention.

FIG. 3A is a schematic view showing a principal part of a keyboard apparatus according to the second embodiment. As shown in FIG. 3A, a key leaf spring 32 corresponding to the front half portion 22 and a hammer leaf spring 33 corresponding to the hammer leaf spring 23 are provided. In the main body of the keyboard apparatus, a contact portion 38 and a contact portion 39 are fixedly provided.

One end portion 32*a* of the key leaf spring 32 is fixed to the lower surface 10*a* of the key 10. The other end portion 32*b* of the key leaf spring 32 does not contact the contact portion 39 in the non-key depression state, but starts to come into contact and engagement with the contact portion 39 from a certain point in the key-depression forward stroke, i.e., in the middle of the key-depression forward stroke. In other words, the position of the contact portion 39 is set as a position at which the other end portion 32*b* comes into abutting contact with the contact portion 39 when the key 10 is located at the key intermediate position indicated above.

On the other hand, one end portion 33*a* of the hammer leaf spring 33 is fixed at a position located rearward of the hammer fulcrum Ph of the hammer body HM. The other end portion 33*b* of the hammer leaf spring 33 does not contact the contact portion 38 in the non-key depression state, but starts to come into contact and engagement with the contact portion 38 from the certain point in the key-depression forward stroke, i.e., in the middle of the key-depression forward stroke. In other words, the position of the contact portion 38 is set as a position at which the other end portion 33*b* comes into abutting contact with the contact portion 38 when the key 10 is located at the key intermediate position indicated above.

The timing at which the other end portion 32*b* and the other end portion 33*b* respectively come into abutting contact with the contact portion 39 and the contact portion 38 in the key-depression forward stroke corresponds to the stroke position x of the key 10. As in the illustrated first embodiment, where the key 10 and the hammer body HM pivot by moving in conjunction with each other while the drive portion 11 of the key 10 and the driven portion 16 of the hammer body HM are held in engagement with each other without separating away from each other, the position of the key 10 or the timing at which the other end portion 32*b* comes into abutting contact with the contact portion 39 substantially coincides with the position of the key 10 and the timing at which the other end portion 33*b* comes into abutting contact with the contact portion 38. Further, the position of the key 10 or the timing described above is set so as to substantially correspond to the position of the key 10 or the timing at which the damper separates away from the associated string in the key-depression forward stroke in acoustic pianos.

In FIG. 3A, the hammer upper-limit stopper 13, the hammer lower-limit stopper 14, the actuator 40, etc., are not illustrated. It is noted that an elastic member corresponding to the rear half portion 21 of the key leaf spring 20 (FIGS. 1A and 1B) may be independently provided. Other structures are similar to those in the first embodiment.

The second embodiment also offers advantages similar to those in the first embodiment as to enabling the key 10 and the hammer body HM to quickly return after termination of the key depression and realizing the load increase feeling corresponding to the damper weight that is felt in acoustic pianos.

<Third Embodiment>

In the first embodiment and the second embodiment illustrated above, the two individual springs are provided, in other words, the spring for giving the return force to the key 10 and the spring for giving the return force to the hammer body HM are provided independently of each other, and each spring is configured to elastically bend between: the key 10 or the hammer body HM; and the main body of the keyboard apparatus. In contrast, in a third embodiment of the present invention, the springs for giving the return force respectively to the key 10 and the hammer body HM are formed integrally with each other as a single spring.

Figure 3B:
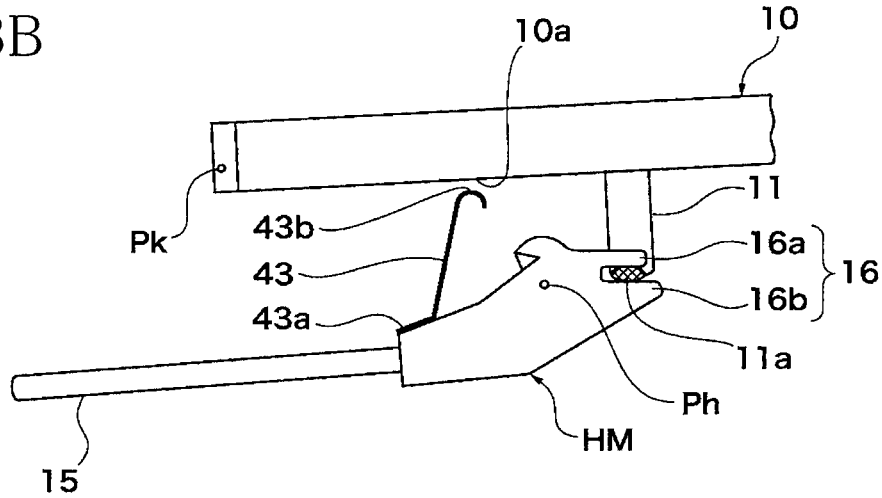

FIG. 3B is a schematic view showing a principal part of a keyboard apparatus according to the third embodiment. As shown in FIG. 3B, a dual-function leaf spring 43 having both of the function of the front half portion 22 and the function of the hammer leaf spring 23 is provided. One end portion 43*a* of the dual-function leaf spring 43 is fixed at a position located rearward of the hammer fulcrum Ph of the hammer body HM. The other end portion 43*b* of the dual-function leaf spring 43 does not contact the lower surface 10*a* of the key 10 in the non-key depression state. Here, both of the pivotal movement of the key 10 in the forward direction and the pivotal movement of the hammer body HM in the forward direction cause the other end portion 43*b* and the lower surface 10*a* to approach each other. Accordingly, the other end portion 43*b* starts to come into contact and engagement with the lower surface 10*a* from a certain point in the key-depression forward stroke, i.e., in the middle of the key-depression forward stroke. That is, the position of the other end portion 43*b* is set as a position at which the key 10 comes into abutting contact with the other end portion 43*b* when the key 10 is located at the key intermediate position indicated above.

In the present embodiment, the drive portion 11 of the key 10 and the driven portion 16 of the hammer body HM are configured to be always kept in engagement with each other. More specifically, a buffer portion 11*a* fixed to the top end of the drive portion 11 is slidably inserted between an upper-side extending portion 16*a* and a lower-side extending portion 16*b* of the driven portion 16. The key 10 and the hammer body HM are configured to pivot, by moving in conjunction with each other, in opposite directions between respective pivotal movement start positions and respective pivotal movement end positions through the constant engagement between: the buffer portion 11*a*; and the upper-side extending portion 16*a* and the lower-side extending portion 16*b*.

Therefore, there does not arise a situation in which the hammer body HM separates away from the key 10 and pivots at a speed different from that of the key depending upon a style of the key depression, whereby the other end portion 43*b* and the lower surface 10*a* are brought into abutting contact with each other in the key-depression forward stroke always at a pre-set stroke position of the key 10. This pre-set stroke position corresponds to the stroke position x indicated above. Other structures are similar to those in the second embodiment.

The third embodiment also offers advantages similar to those in the first embodiment as to enabling the key 10 and the hammer body HM to quickly return after termination of the key depression and realizing the load increase feeling corresponding to the damper weight that is felt in acoustic pianos.

In the first and second embodiments illustrated above, it is not necessarily easy to permit the position of the key or the timing at which one of the two springs applies the elastic force and the position of the key or the timing at which the other of the two springs applies the elastic force to completely coincide with each other. According to the present embodiment, however, it is required to set only timing for application of the elastic force by the one dual-function leaf spring 43, so that the two timing do not deviate from each other. Therefore, irrespective of the key depression style, it is possible to accurately set the position or the timing at which the reaction force is increased in the middle of the key depression (at which the load is increased by an amount corresponding to the damper weight) and to ensure a clear touch. Further, the number of the elastic portions is only one, resulting in a reduction of the number of components.

<Fourth Embodiment>

Figure 3C:
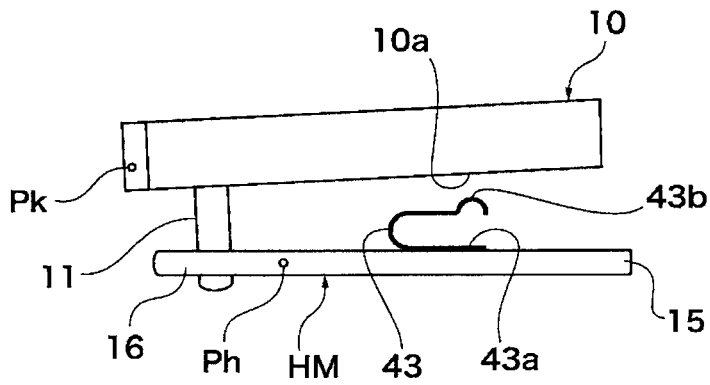

FIG. 3C is a schematic view showing a principal part of a keyboard apparatus according to a fourth embodiment of the present invention. In the fourth embodiment, the dual-function leaf spring 43 is applied to the keyboard apparatus in which the direction of the pivotal movement of the hammer body HM is opposite, in side view, to the direction of the pivotal movement of the key 10, as compared with the keyboard apparatus of the third embodiment.

That is, the rod-like portion 15 of the hammer body HM extends frontward. The drive portion 11 of the key 10 and the driven portion 16 of the hammer body HM are always kept in engagement with each other as in the third embodiment, and the key 10 and the hammer body HM are configured to pivot in mutually opposite directions by moving in conjunction with each other. Other structures are similar to those in the third embodiment.

As shown in FIG. 3C, the one end portion 43*a* of the dual-function leaf spring 43 is fixed at a position that is located frontward of the hammer fulcrum Ph of the hammer body HM. In other words, the one end portion 43*a* of the dual-function leaf spring 43 is fixed at the position at which the one end portion 43*a* approaches the lower surface 10*a* of the key 10 when the hammer body HM pivots in the forward direction. This is true of the second embodiment shown in FIG. 3A and the third embodiment shown in FIG. 3B. The other end portion 43*b* does not contact the lower surface 10*a* of the key 10 in the non-key depression state and starts to come into contact and engagement with a certain point in the key-depression forward stroke, i.e., in the middle of the key-depression forward stroke. In other words, the position of the other end portion 43*b* is set as a position at which the key 10 comes into abutting contact with the other end portion 43*b* when the key 10 is located at the key intermediate position indicated above.

This fourth embodiment ensures advantages similar to those in the third embodiment.

In the third embodiment shown in FIG. 3B and the fourth embodiment shown in FIG. 3C, the one end portion 43*a* of the single dual-function leaf spring 43 may be fixed to the key 10 in place of being fixed to the hammer body HM. In this instance, the other end portion 43*b* of the dual-function leaf spring 43 is disposed such that the other end portion 43*b* starts to come into abutting contact, from a certain point in the key-depression forward stroke, with a portion of the hammer body HM to which the other end portion 43*b* gets closer when the key 10 pivots in the forward direction.

As in the first embodiment, in the second through the fourth embodiments, the position at which the leaf spring applies the elastic force is not limited to the stroke position x as long as the position is in the middle of the key-depression forward stroke, when focusing only on the advantage of quick return of the key 10 and the hammer body HM after termination of the key depression.

In the illustrated embodiments, the elastic force is applied by the key leaf spring 20, 32, the hammer leaf spring 23, 33, and the dual-function leaf spring 43 each as an elastic portion, to both of the key 10 and the hammer body HM from the certain point in the key-depression stroke. The elastic force may be applied by the elastic portion to only one of the key 10 and the hammer body HM from the certain point in the key-depression stroke.

In the illustrated first embodiment, the key leaf spring 20 has the rear half portion 21 functioning as the key return spring and the front half portion 22 as the second elastic portion. The key leaf spring may be configured to have the front half portion without having the rear half portion functioning as the key return spring.

The illustrated third and fourth embodiments may be expressed as follows. In the keyboard apparatus, the key and the hammer body may be configured to pivot between the respective pivotal movement start positions and the respective pivotal movement end positions via the engagement of the key and the hammer body, by moving in conjunction with each other. In this instance, the elastic position (43) may be configured such that one end portion (43*a*) thereof is fixed to one of the key and the hammer body while the other end portion (43*b*) thereof does not engage with the other of the key and the hammer body in the non-key depression state, and the elastic position (43) may be configured so as to be disposed such that the other end portion thereof starts to come into engagement with the other of the key and the hammer body from the certain point in the key-depression forward stroke and to apply the elastic force thereto, thereby applying a force to push the other of the key and the hammer body toward the pivotal movement start position. In this arrangement, irrespective of the key depression style, it is possible to accurately set a position of the key or timing at which the reaction force is increased in the middle of key depression (e.g., at which the load is increased by an amount corresponding to the damper weight). Further, the number of the required elastic portions is only one.

While the embodiments of the present invention have been described above, it is to be understood that the invention is not limited to the details of the embodiments, but may include various forms without departing from the scope of the invention defined in the following claims. Portions of the embodiments may be suitably combined.

What is claimed is:

1. A keyboard apparatus, comprising:

a key configured to be pivotable about a key fulcrum, by a depressing operation and a release operation, between: a pivotal movement start position corresponding to a non-key depression state; and a pivotal movement end position corresponding to a key-depression end state;

a hammer body configured to be pivotable about a hammer body fulcrum, by the depressing operation and the release operation of the key, between: a pivotal movement start position corresponding to the non-key depression state; and a pivotal movement end position corresponding to the key-depression end state and configured to impart inertia to the depressing operation of the key; and an elastic portion configured to be capable of applying an elastic force to at least one of the key and the hammer body, wherein the elastic portion is configured not to apply the elastic force to the key and the hammer body in the non-key depression state and configured to start to apply the elastic force in a direction toward the pivotal movement start position to the at least one of the key and the hammer body from a certain point in a forward stroke of the depressing operation of the key.

2. The keyboard apparatus according to claim 1, wherein the certain point in the forward stroke of the depressing operation of the key corresponds to a position of the key or timing at which a damper separates away from an associated string in a forward stroke of a depressing operation of a key in an acoustic piano.

3. The keyboard apparatus according to claim 1, wherein the elastic portion includes: a first elastic portion configured not to apply the elastic force to the hammer body in the non-key depression state and configured to start to apply, to the hammer body, the elastic force in the direction toward the pivotal movement start position from the certain point in the forward stroke of the depressing operation of the key; and a second elastic portion configured not to apply the force to the key in the non-key depression state and configured to start to apply, to the key, the force in the direction toward the pivotal movement start position from the certain point in the forward stroke of the depressing operation of the key.

4. The keyboard apparatus according to claim 3, wherein the elastic portion further includes a third elastic portion different from the second elastic portion and configured to apply, to the key, the force in the direction toward the pivotal movement start position.

5. The keyboard apparatus according to claim 4, wherein the second elastic portion and the third elastic portion are constituted by one leaf spring.

6. The keyboard apparatus according to claim 1, wherein the elastic portion is configured not to apply the force to the hammer body and the key in the non-key depression state and configured to apply, to the hammer body and the key, the force in the direction toward the pivotal movement start position from the certain point in the forward stroke of the depressing operation of the key.

7. The keyboard apparatus according to claim 6, wherein the elastic portion is constituted by one leaf spring.

8. The keyboard apparatus according to claim 3, wherein, in an instance where the key and the hammer body pivot in the forward stroke of the key depressing operation while being held in engagement with each other, a position of the key or timing at which the elastic force is applied by the first elastic portion to the hammer body is substantially identical to a position of the key or timing at which the elastic force is applied by the second elastic portion to the key.

* * * * *